US005480166A

United States Patent [19]

Milsop

[11] Patent Number: 5,480,166

[45] Date of Patent: Jan. 2, 1996

[54] MULTI-PURPOSE TOOL HOLDER

[76] Inventor: Edward Milsop, 93 Land of Nod Rd., Windham, Me. 04062

[21] Appl. No.: 308,289

[22] Filed: Sep. 19, 1994

[51] Int. Cl.[6] ..... B25F 1/02

[52] U.S. Cl. ..... 279/143; 7/142; 7/167; 81/437; 81/177.1; 408/239 A

[58] Field of Search ..... 7/100, 138, 142, 7/165, 167; 81/177.1, 177.2, 177.85, 437–439, 125, 125.1, 121.1, 124.4; 279/143–145; 408/239 R, 239 A

[56] References Cited

U.S. PATENT DOCUMENTS

| | | | |
|---|---|---|---|
| 4,056,020 | 11/1977 | Coviello | 81/177.2 |
| 4,774,736 | 10/1988 | Brawner et al. | 81/437 |
| 4,899,415 | 2/1990 | Wheeler | 81/177.1 |
| 4,960,016 | 10/1990 | Seals | 81/177.4 |

*Primary Examiner*—Steven C. Bishop
*Attorney, Agent, or Firm*—Frederick R. Cantor

[57] ABSTRACT

A multi-purpose tool holder is described, which includes an elongated cylindrical barrel having a non-circular socket in one end for attachment of the barrel to a ratchet-type turning implement. The other end of the barrel forms a slideway for two transversely adjustable jaws that have facing V-shaped grooves designed to grip tool shanks of varying size and shape. An adjusting screw is provided for each jaw, such that the jaws can be held in selected positions of adjustment. The elongated barrel is usable between a turning implement and tool shank gripped by the adjustable jaws. The elongated barrel can also be used as a handle to perform a tool turning operation. For this purpose various sockets are formed in the side surface of the barrel. The shanks of selected tools can be selectively inserted into the various sockets to operatively connect the barrel to the tool.

6 Claims, 1 Drawing Sheet

MULTI-PURPOSE TOOL HOLDER

BACKGROUND OF THE PRESENT INVENTION

1. Field of the Invention

The present invention relates to a multi-purpose tool holder.

The present invention relates, more particularly, to a multi-purpose tool holder, especially a tool holder for gripping or otherwise supporting the shank portions of tools to facilitate tool operations. The tool holder is particularly designed for use with rotary tools, such as taps, reamers, spark plug wrenches, screwdriver bits, easy outs, and wood augers. The tool holder can also be used with some non-rotary tools, such as punches and files.

2. Prior Developments

Various types of tool holders have been proposed for gripping or holding tools for turning or storage purposes.

U.S. Pat. No. 4,566,357 to P. Carossino, shows a tool holder having a first hexagonal bore in its end surface, and a second transverse hexagonal bore in its side surface, whereby an Allen wrench can have various relationships to the holder. Apparently, the tool holder is limited to usage with a single size Allen wrench or other tool having a particular hexagonal size shank.

U.S. Pat. No. 1,970,409 to O. Wiedmann, shows a T-shaped ratchet turning implement having a detachable shank, whereby the implement can be used with different shank-type tools, e.g., a screwdriver, socket or drill chuck.

Berry U.S. Pat. No. 5,218,730 shows a special purpose wrench designed specifically for removing and installing lug nuts on vehicle wheels. The conventional socket 36 is slidably adjustable on a telescopic tube assembly for achieving optimum leverage during the wrench operation.

Jang U.S. Pat. No. 4,542,667 shows a tool handle having two foldable hand grips retractable into slots in the side surface of the barrel portion of the handle, for storage purposes.

U.S. Pat. No. 3,957,096 to V. Rodman, shows a turning implement that comprises a chuck 22 adapted to grip various tool shanks e.g., a screwdriver or twist drill. A shaft 18 extends axially from the chuck for passage through the ratchet opening of a conventional ratchet wrench 26. The handle of the wrench can be used to apply a turning torque. A ball-type palm grip 12 is located on the upper end of the shaft, whereby the person is enabled to apply an axial pressure to the tool while the tool is being turned with the ratchet wrench.

U.S. Pat. No. 4,960,016 to R. Seals, shows a tool kit wherein various size sockets are stored within a hollow tubular handle 12. A ratchet drive element 20 can be telescopically fitted onto one end of the tubular handle; a screwdriver shank extends from the ratchet drive element for storage within the tubular handle. An adjustable wrench element 30 has a hexagonal shank for insertion into the other end of the tubular handle. Transverse holes are provided in one end of the tubular handle to accommodate the screwdriver shank, whereby the screwdriver can be used as a handle (as shown in FIG. 4); in the FIG. 4 configuration the tubular handle 12 acts as a wrench socket for installing or removing an engine spark plug.

Brawner U.S. Pat. No. 4,774,736 shows a tool kit especially designed for use by skateboarders for adjusting and changing components on a skateboard. The kit is adapted to mount various wrench sockets and two types of screwdriver bits.

Rolland U.S. Pat. No. 2,786,380 discloses a holder for mounting (or storing) various size Allen wrench elements. Each wrench element is pivotably attached to one end of the holder for movement between an extended position projecting right angularly from the holder and a storage position folded into a slot in the holder side surface.

SUMMARY OF THE PRESENT INVENTION

The present invention relates to a tool holder adapted to interchangeably grip various different tools having different shank sizes and cross-sectional configurations. In one particular embodiment, the invention comprises a cylindrical barrel having a square socket in one end for accommodating the ratchet drive element of a conventional turning implement; a set screw is mounted in the barrel for securing the ratchet drive element to the barrel.

The other end of the barrel forms a slideway for two transversely adjustable jaws; the facing surfaces of the jaws have V-shaped grooves therein, whereby the jaws are enabled to grip tool shanks of various different diameters and cross-sectional shapes. Two screws are threaded into the barrel to clamp the jaws on the selected tool shank.

At approximately the midpoint along the length of the barrel there is provided a square socket adapted to receive a tool, e.g., a spark plug wrench. The barrel can therefore be utilized as a handle for turning the associated tool. An additional socket opening is provided in the barrel side surface for receiving a tool shank having a circular cross-section. The barrel can thus be used as a handle for turning various different tools, e.g., tools having square shanks or circular shanks.

In summary, and in accordance with the above discussion, the foregoing objectives are achieved in the following embodiments.

1. A multi-purpose tool holder, comprising:

an elongated barrel having a longitudinal axis;

a linear side surface paralleling said longitudinal axis;

a first end surface extending transverse to said longitudinal axis;

a second end surface extending transverse to said longitudinal axis;

a first non-circular cross-sectioned socket in said first end surface adapted to receive therein the drive plug of a turning implement, whereby said barrel is turnable around said longitudinal axis;

a linear slideway formed in said barrel proximate to said second end surface;

said slideway comprising parallel guide surfaces extending transverse to said longitudinal axis;

two jaws slidably mounted in said slideway for linear movement toward and away from said longitudinal axis;

said jaws having facing V cross-sectioned grooves therein adapted to grip the corners of a square cross-sectioned tool shank positionable in the space between the jaws;

an adjustment screw associated with each jaw for holding each jaw in selected positions of adjustment in said slideway, whereby the jaws are enabled to grip tool shanks having different cross-sectional dimensions;

a second socket formed in the side surface of said barrel at an intermediate point along the barrel longitudinal dimension;

said second socket having a square cross-section for receiving therein a square cross-sectioned tool shank, whereby said barrel is usable as a handle for turning a tool whose shank is sealed in said second socket;

a third socket formed in the side surface of said barrel in near proximity to said second socket; said third socket having a circular cross-section for receiving therein a circular cross-sectioned tool shank; and said barrel being usable as a handle for turning a tool whose shank is seated in said third socket.

2. The multi-purpose tool holder, as described in paragraph 1, wherein each said adjustment screw has a circular head swivably connected to said screw and a threaded shank threadably connected to said barrel.

3. The multi-purpose tool holder, as described in paragraph 2, and further comprising a non-circular drive slot in the threaded shank of each adjustment screw.

4. The multi-purpose tool holder, as described in paragraph 2, wherein said linear slideway comprises a linear slot extending transversely through said barrel;

said linear slot having end portions thereof in the barrel side surface;

closure walls anchored within the end portions of said linear slot; and the threaded shanks of said adjustment screws being threadably connected to said closure walls.

5. The multi-purpose tool holder, as described in paragraph 1, wherein said first socket has an internal end surface, and a cylindrical bore extending from said internal end surface on the barrel longitudinal axis; and said bore being adapted to receive therein the shank portion of a hole punch, whereby said barrel constitutes a holder for the punch.

6. The multipurpose tool holder, as described in paragraph 1, wherein the side surface of said barrel is cylindrical.

BRIEF DESCRIPTION OF THE DRAWINGS OF THE PRESENT INVENTION

DESCRIPTION OF THE PREFERRED EMBODIMENTS OF THE PRESENT INVENTION

Figure 1:
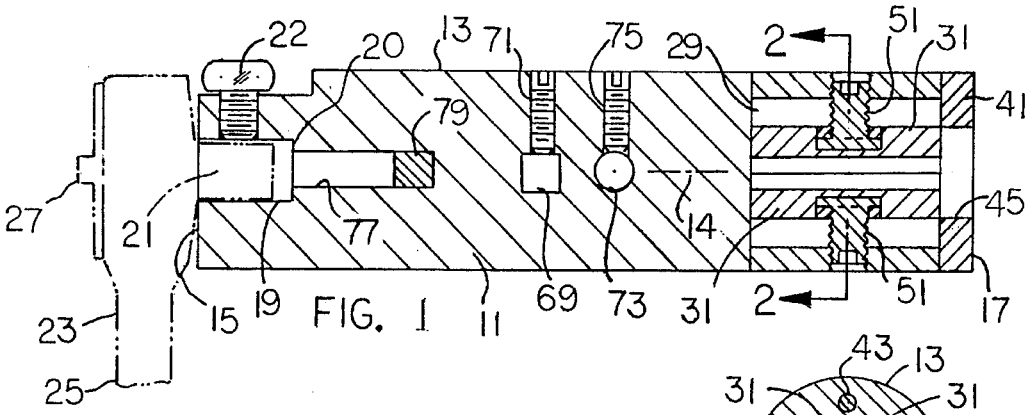
FIG. 1, is a longitudinal cross-sectional view of a tool holder constructed according to the invention.

FIG. 1, is a longitudinal cross-sectional view of a tool holder constructed according to the invention.

FIG. 1 shows a multi-purpose tool holder, that comprises an elongated barrel 11 having a cylindrical side surface 13 concentric with the barrel longitudinal axis 14. The barrel 11 can have various different dimensions. However, typically the barrel will have a length of about five inches, and a transverse diameter of about one and one-fourth inch.

Barrel 11 can be formed of various different materials, e.g., steel, aluminum, or rigid plastic. Certain surfaces on the barrel 11 will be machined to precise dimensions. As shown in FIG. 1, barrel 11 has a first end surface 15 extending transverse to axis 14, and a second end surface 17 extending transverse to axis 14.

A square socket 19 is formed in barrel end surface 15 to receive therein the drive plug 21 of a ratchet-type turning implement 23. Implement 23 is a conventional ratchet-type turning implement having a handle 25 that typically has a length of about eight inches, whereby the handle 25 can be manually grasped to rotate plug 21 around the plug axis. When the plug 21 is inserted into socket 19 the plug axis, is coincident with barrel axis 14, so that manual rotation of turning implement 23 is effective to rotate the barrel 11 around axis 14. A set screw 22 can be provided in the barrel to hold the barrel on plug 21.

Turning implement 23 is equipped with a directional control knob, or button, 27, that can be operated to select the drive direction, i.e., clockwise or counterclockwise. Implement 23 is a commercially available construction.

Figure 2:
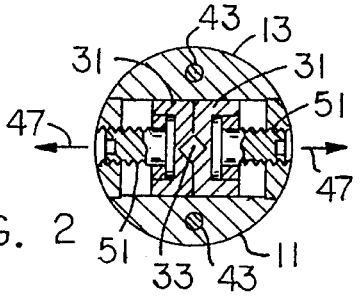
FIG. 2, is a transverse sectional view taken on line 2—2 in FIG. 1.
Figure 3:
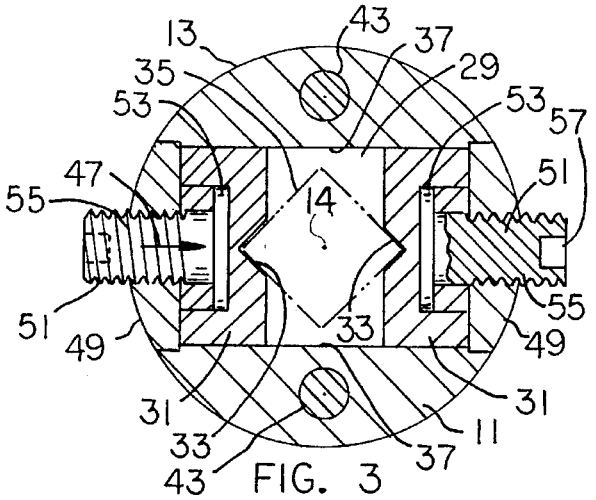
FIG. 3, is a sectional view taken in the same direction as FIG. 2, but enlarged to show structural details, and with two too- gripper jaws in different positions of adjustment.

FIG. 3, is a sectional view, taken in the same direction as FIG. 2, but enlarged to show structural details, and with two tool-gripper jaws in different positions of adjustment.

Proximate to the right end surface 17 of the barrel 11, there is provided a linear slideway 29 for slidably supporting two movable jaws 31. These jaws 31 have facing V cross-sectioned grooves 33 therein adapted to grip a tool shank positioned in the space between the two jaws. FIG. 3, includes four dashed lines 35 that define the outline of a square cross-sectioned tool shank in the grip of the two jaws 31. The jaws are adjustable (movable) toward or away from barrel axis 14, whereby the jaws can grip different shanks having different cross-sectional dimensions.

The linear slideway 29 comprises a guide slot extending transversely through barrel 11 to form two flat parallel guide surfaces 37, and an interconnecting flat surface 39. Each jaw 31 is a rectangular block, preferably formed of steel, and dimensioned to slidably fit within the space circumscribed by surfaces 37, 39 and 37.

The rightmost end of the guide slot is closed by a circular steel plate 41 that is secured to the barrel body by two screws 43 (FIG. 3) extending through the plate 41 parallel to barrel axis 14. A circular hole 45 is formed in plate 41 for accommodating the tool shank. The left face 42 of plate 41 (in FIG. 1) forms a guide surface for jaws 31, whereby the jaws 31 are enabled to slide back and forth in the space circumscribed by surfaces 37, 39, 37 and 42. The movement path of jaws 31 is indicated by numeral 47.

FIG. 2, is a transverse sectional view taken on line 2—2 in FIG. 1.

Opposite ends of the guide slot are closed by two segment-shaped closure walls 49. Each closure wall 49 is preferably seated within the guide slot and affixed to the barrel 11 body by adhesives or electron beam welding, whereby the closure walls 49 form stops for limiting the motion of each jaw 31 away from barrel axis 14. FIG. 3, shows the jaws at the outward limit of jaw motion. FIG. 2, shows the jaws 31 at the inward limit of jaw motion.

An adjustment screw 51 is associated with each jaw 31 for holding the jaw in selected positions of adjustment. Each screw 51 comprises a circular head 53 having a swivel fit in the associated jaw, and a threaded shank 55 threadably connected to one of the closure walls 49. A hexagonal slot, or recess, 57, is formed in the end of each threaded shank 55 so that the screw 51 can be turned, by means of an Allen wrench inserted into the hex recess. By turning each screw 51 it is possible to slide the associated jaw 31 toward, or away, from the barrel longitudinal axis 14, whereby the jaws 31 are enabled to grip tool shanks of varying cross-sectional dimensions.

The V cross-sectioned grooves 33 in the facing surfaces of jaws 31 are designed specifically to grip varying sizes of square cross-sectioned shanks, to prevent the shanks from slipping (turning) while the turning implement 23 is being manipulated to rotate the tool around axis 14. However, various cross-sectional shank configurations can be gripped by the V grooves 33, e.g., circular, hexagonal or fluted.

Figure 5:
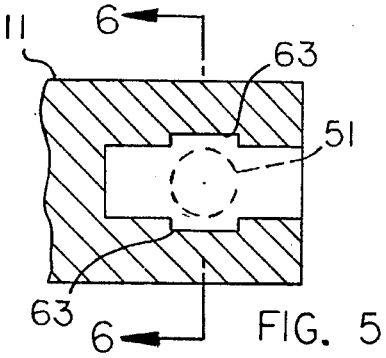
FIG. 5, is a fragmentary sectional view of another tool holder embodying the invention.

FIG. 5, is a fragmentary sectional view, of another tool holder embodying the invention.

Figure 6:
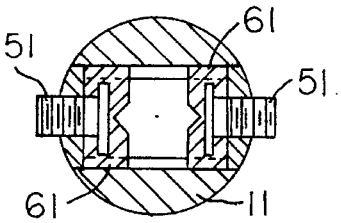
FIG. 6, is a transverse sectional view taken on line 6—6 in FIG. 5.

FIG. 6, is a transverse sectional view, taken on line 6—6 in FIG. 5.

FIGS. 1 through 3, show a preferred jaw construction. However, some variations in jaw design and jaw guidance means can be made, while still practicing the invention. FIGS. 5 and 6, show one variant in jaw design that can be used. In this case, each jaw has two rectangular ribs 61 that mate with grooves 63 in slot surfaces 37.

Grooves 63 guide the jaws for slidable movement, so that circular plate 41 is unnecessary. In other respects, the jaw construction of FIGS. 5 and 6 is similar to the jaw construction used in the tool holder of FIGS. 1 through 3.

As thus far described, the tool holder is used as a chuck or tool gripper connection between the turning implement 23 and the shank of the tool being rotated. The tool can be any shaft-type tool that is rotated to perform its specific functions, e.g., a threading tool (tap), reamer, wrench extension, screwdriver bit, easy out, wood auger, or boring tool.

Figure 4:
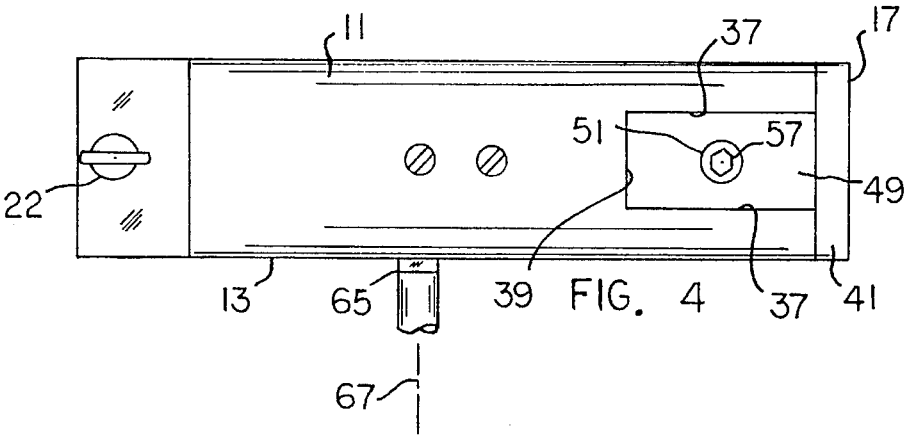
FIG. 4, is an elevational view of the FIG. 1 tool holder.

FIG. 4, is an elevational view, of the FIG. 1 tool holder.

The illustrated tool holder can also be used as a turnable handle, separate from turning implement 23. FIG. 4, shows the tool holder attached to the shank portion 65 of a tool bit for rotating the tool bit around axis 67 of shank portion 65. The person grasps barrel 11 with one, or both, hand(s) to effect a turning operation of the barrel and associated tool bit.

To adapt barrel 11 for use as a turnable handle, two or more sockets are formed in the barrel side surface 13. As shown in FIG. 1, there is a square cross-sectioned socket 69 designed to fit a tool shank having a square cross-section; a set screw 71 is associated with socket 69 for securing the shank against slippage out of the socket.

An additional circular cross-sectioned socket 73 is formed in the barrel side surface 13 to accommodate tool shanks having circular cross-sections. A set screw 75 is provided for releasably securing the tool shank to barrel (handle) 11.

Sockets 69 and 73 are located relatively close together near the midpoint of the barrel 11, i.e. a point midway between the opposite ends 15 and 17 of the barrel. With such an arrangement, the barrel 11 can be used as a turning device for turning the selected tool around the tool axis. Additional sockets of varying sizes can be formed in the barrel side surface 13, if so desired.

Barrel 11 is further adapted for use in holding a punch while the punch is being applied or hammered against a work surface. The punch can take various forms, e.g., a pointed punch used to mark a center, or a blunt end punch used to dislodge a pin out of a hole, or a punch used to punch a hole in sheet-metal, or a punch used to line up holes in multiple sheets for fastening purposes.

As shown in FIG. 1, a cylindrical bore 77 extends axially from internal end surface 20 of socket 19 to form a cylindrical support surface for a punch (tool) of conventional design; the bore surface frictionally grips the punch to retain the punch in a desired position. A hardened steel bar 79 can be extended through a transverse hole in barrel 11 to provide a hard non-deformable seating surface for the end of the punch.

Barrel 11 can be used as a holder for the punch while the punch is being used to mark or exert force on the work. The person can manually grasp barrel 11 to hold the punch in position while a hammer blow is being delivered to barrel end surface 17. The side surface 13 of the barrel 11 is cylindrical so that it is readily grasped.

The present invention provides a multi-purpose tool holder. The drawings herein necessarily depict specific structural features .and embodiments of the multi-purpose tool holder, useful in the practice of the present invention.

However, it will be appreciated by those skilled in the arts pertaining thereto, that the present invention can be practiced in various alternate forms and configurations. Further, the previously detailed descriptions of the preferred embodiments of the present invention, are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. A multi-purpose tool holder, comprising:

an elongated barrel having a longitudinal axis;

a linear side surface paralleling said longitudinal axis;

a first end surface extending transverse to said longitudinal axis;

a second end surface extending transverse to said longitudinal axis;

a first non-circular cross-sectioned socket in said first end surface adapted to receive therein the drive plug of a turning implement, whereby said barrel is turnable around said longitudinal axis;

a linear slideway formed in said barrel proximate to said second end surface;

said slideway comprising parallel guide surfaces extending transverse to said longitudinal axis;

two jaws slidably mounted in said slideway for linear movement toward and away from said longitudinal axis;

said jaws having facing V cross-sectioned grooves therein adapted to grip the corners of a square cross-sectioned tool shank positionable in the space between the jaws;

an adjustment screw associated with each jaw for holding each jaw in selected positions of adjustment in said slideway, whereby the jaws are enabled to grip tool shanks having different cross-sectional dimensions;

a second socket formed in the side surface of said barrel at an intermediate point along the barrel longitudinal dimension;

said second socket having a square cross-section for receiving therein a square cross-sectioned tool shank, whereby said .barrel is usable as a handle for turning a tool whose shank is sealed in said second socket;

a third socket formed in the side surface of said barrel in near proximity to said second socket; said third socket having a circular cross-section for receiving therein a circular cross-sectioned tool shank; and said barrel being usable as a handle for turning a tool whose shank is seated in said third socket.

2. The multi-purpose tool holder, as described in claim 1, wherein each said adjustment screw has a circular head swivelably connected to said screw and a threaded shank threadably connected to said barrel.

3. The multi-purpose tool holder, as described in claim 2, and further comprising a non-circular drive slot in the threaded shank of each adjustment screw.

4. The multi-purpose tool holder, as described in claim 2, wherein said linear slideway comprises a linear slot extending transversely through said barrel;

said linear slot having end portions thereof in the barrel side surface;

closure walls anchored within the end portions of said linear slot; and the threaded shanks of said adjustment screws being threadably connected to said closure walls.

5. The multi-purpose tool holder, as described in claim 1, wherein said first socket has an internal end surface, and a cylindrical bore extending from said internal end surface on the barrel longitudinal axis; and said bore being adapted to receive therein the shank portion of a hole punch, whereby said barrel constitutes a holder for the punch.

6. The multipurpose tool holder, as described in claim 1, wherein the side surface of said barrel is cylindrical.

* * * * *